United States Patent [19]

Kellner

[11] Patent Number: 4,986,295

[45] Date of Patent: Jan. 22, 1991

[54] COMBINATION CANE AND CRIBBAGE BOARD

[76] Inventor: Thomas D. Kellner, 7115 Spring Hill Drive, Spring Hill, Fla. 34606

[21] Appl. No.: 340,519

[22] Filed: Apr. 19, 1989

[51] Int. Cl.[5] ..... A45B 3/00

[52] U.S. Cl. ..... 135/66; D. 10/46.1; 273/248

[58] Field of Search ..... 135/66; D10/46.1; 273/126 A, 248

[56] References Cited

U.S. PATENT DOCUMENTS

| | | | |
|---|---|---|---|
| D. 283,600 | 4/1986 | Hammond | D10/46.1 |
| D. 302,135 | 7/1989 | Thielen | D10/46.1 |
| 370,496 | 9/1887 | Seliger | 135/66 |
| D. 474,422 | 6/1915 | Read | D10/46.1 |
| 859,692 | 7/1907 | Robbins | 273/248 |
| 1,867,170 | 7/1932 | Poetsch | 273/162 A |
| 1,996,553 | 4/1966 | Scully | 135/66 |
| 1,997,382 | 4/1935 | Howell | 273/DIG. 26 |
| 2,198,082 | 4/1940 | Harty | 135/66 |
| 4,526,371 | 7/1985 | Venditti | 273/148 |

FOREIGN PATENT DOCUMENTS

| | | | |
|---|---|---|---|
| 78068 | 3/1894 | Fed. Rep. of Germany | 135/66 |
| 909552 | 5/1946 | France | 135/66 |
| 5526 | of 1899 | United Kingdom | 135/66 |

*Primary Examiner*—Henry E. Raduazo

*Attorney, Agent, or Firm*—H. Jay Spiegel

[57] ABSTRACT

Disclosed is a cane having a handle, an elongated shaft, and a tip. Along the shaft, a scoring board designed to be used in playing the game of cribbage is provided. The scoring board includes a start region and an end region and between these regions a pair of parallel tracks of holes in which pegs may be placed to score the cribbage game. A storage compartment for the pegs as well as a storage compartment for a pill bottle may be provided. The cane may have reflectors on its side.

7 Claims, 1 Drawing Sheet

COMBINATION CANE AND CRIBBAGE BOARD

BACKGROUND OF THE INVENTION

The present invention relates to a combination cane and cribbage board. In the prior art, canes per se are known as are cribbage boards. However, the prior art fails to teach the combination of a cane and a cribbage board which is a useful device allowing mobility for an elderly or injured person while allowing them to play a game of cribbage, carrying the scoring board with them.

Applicant is aware of U.S. Pat. No. 2,364,814 to Plummer et al. and U.S. Pat. No. 2,434,495 to Holton. These patents are both directed to the game of cribbage and a cribbage board therefor, per se. Thus, these patents are only of general interest concerning the teachings of the present invention.

SUMMARY OF THE INVENTION

The present invention relates to a combination cane and cribbage board. In the game of cribbage, a scoring board is used to tally game points. Standard scoring boards for scoring cribbage games are usually made of a single piece of material having two elongated sections perforated with a series of small holes into which small pegs are inserted to indicate the progress of the game.

Of course, canes designed to be used to assist a person in walking or in supporting a person are also known.

The present invention includes the following interrelated aspects and features:

(a) In a first aspect, the inventive device consists of a cane having a handle, an elongated shaft, and a tip.

(b) On one side of the elongated shaft, between the tip and handle, a cribbage board is provided.

(c) The cribbage board includes a start region, an end region, and between these regions, two parallel lines of holes. The holes are sized to receive pegs which are placed in the holes during the playing of a cribbage game. Each player is assigned one line of holes and as the game progresses, the pegs are moved along the lines of holes from the start region to the end region. A storage compartment for the pegs is provided.

(d) Additionally, a storage compartment for a pill bottle may be provided. Also, reflectors may be provided on the cane for night use.

Accordingly, it is a first object of the present invention to provide a combination cane and cribbage board.

It is a further object of the present invention to provide such a device wherein one face of the shaft of the cane has the cribbage scoring board formed thereon.

It is a yet further object of the present invention to provide such a device wherein the cribbage scoring board includes a pair of parallel lines of holes in which pegs may be selectively placed.

It is a yet further object of the present invention to provide storage compartments for the pegs as well as for a pill bottle.

These and other objects, aspects and features of the present invention will be better understood from the following detailed description of the preferred embodiment when read in conjunction with the appended drawing figure.

SPECIAL DESCRIPTION OF THE PREFERRED EMBODIMENT

Figure 1:
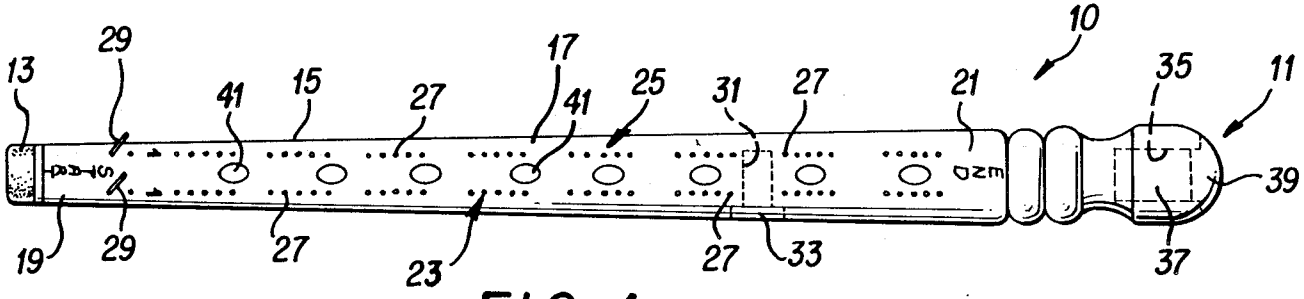
FIG. 1 shows a side view of the present invention.

With reference to FIG. 1, the present invention is generally designated by the reference numeral 10 and is seen to include a handle portion 11, a tip 13 preferably made of rubber and designed to grip a ground surface, and an elongated shaft 15 between the handle 11 and tip 13 which tapers from a larger diameter adjacent the handle portion 11 to a smaller diameter adjacent the tip 13.

The shaft 15 has a cribbage board incorporated therewith which is generally designated by the reference numeral 17. The cribbage board 17 includes a start region 19, an end region 21 and, therebetween, two lines 23, 25 of holes 27 which extend in parallel paths from the start region 19 to the end region 21.

In playing a game of cribbage, the cribbage board 17 may be used to score the game. For this purpose, pegs 29 are provided which are sized to be easily inserted into and removed from any of the holes 27 in the scoring board 17.

A storage compartment 31 is provided to allow storage of the pegs 29. A cover 33 for the compartment 31 is preferably made of a transparent material such as that which is marketed under the trademark PLEXIGLAS. A further storage compartment 35 is provided and is sized to removably receive a pill bottle 37. A cap 39 for the compartment 35 is also preferably transparent.

The cane 10 may have a plurality of reflectors 41 along one or more sides to enhance night visibility.

Figure 2:
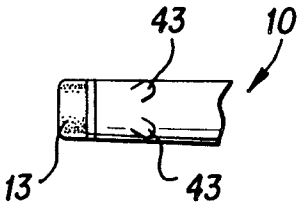
FIG. 2 shows a side view of the present invention rotated 180 degrees from the FIG. 1 view.

Finally, with reference to FIG. 2, feet 43, preferably made of rubber, may be provided to enhance stability when the cane 10 is being used as a cribbage board. In particular, the feet 43 prevent rolling of the cane 10.

As such, an invention has been disclosed in terms of a preferred embodiment thereof which fulfills each and every one of the objects of the invention as set forth hereinabove, and provides a new and improved combination device which allows one to support oneself while also allowing one to play a cribbage game.

Of course, various changes, modifications, and alterations of teachings of the present invention may be contemplated by those skilled in the art without departing from the intended spirit and scope thereof. As such, it is intended that the present invention only be limited by the terms of the appended claims.

I claim:

1. In a cane having a handle portion, a tip portion designed to grip a ground surface and an elongated shaft therebetween tapering from a larger diameter adjacent said handle portion to a smaller diameter adjacent said tip portion, the improvement comprising a cribbage scoring board including a plurality of parallel lines of holes formed exteriorly on said cane and a stabilizing means for stabilizing said cane while said board is in use, said stabilizing means further comprising feet on said cane on a face opposed to said board, which feet prevent rolling of said cane.

2. The invention of claim 1, wherein said board is confined to said elongated shaft.

3. The invention of claim 1, wherein said lines extend between a start region and an end region.

4. The invention of claim 1, further including pegs selectively placeable in any of said holes.

5. The invention of claim 4, further including a storage compartment for said pegs.

6. The invention of claim 1, further including at least one reflector on said shaft.

7. The invention of claim 1, further including a storage compartment for a container.

* * * * *